US005816796A

United States Patent [19]

Broach

[11] Patent Number: 5,816,796

[45] Date of Patent: Oct. 6, 1998

[54] FLUE GAS CONTROL

[75] Inventor: George C. Broach, Tulsa, Okla.

[73] Assignee: The G. C. Broach Company, Tulsa, Okla.

[21] Appl. No.: 873,811

[22] Filed: Jun. 12, 1997

[51] Int. Cl.[6] ..... F27B 5/16

[52] U.S. Cl. ..... 432/29; 432/209; 34/86; 122/7 R

[58] Field of Search ..... 432/28, 29, 30, 432/197, 209, 212, 223; 34/86; 122/7 R

[56] References Cited

U.S. PATENT DOCUMENTS

| | | | |
|---|---|---|---|
| 3,854,455 | 12/1974 | Carson et al. | 122/356 |
| 3,861,334 | 1/1975 | Stockman | 110/10 |
| 3,913,501 | 10/1975 | Dahar | 110/8 R |
| 4,101,265 | 7/1978 | Broach | 423/29 |
| 4,262,608 | 4/1981 | Jackson | 110/162 |
| 4,449,569 | 5/1984 | Lisi et al. | 165/1 |
| 4,485,746 | 12/1984 | Erlandsson | 110/234 |
| 4,628,869 | 12/1986 | Symsek et al. | 122/20 B |
| 4,898,146 | 2/1990 | Stapensea | 165/40 |

*Primary Examiner*—Teresa J. Walberg
*Assistant Examiner*—Gregory A. Wilson
*Attorney, Agent, or Firm*—Robert E. Massa

[57] ABSTRACT

A furnace for heating a process fluid stream which includes means for precisely controlling the temperature of preheated combustion air. The system includes a process fluid stream being heated within the furnace and an adjunct loop fluid stream line which acts as a heat exchange system by communication with the process fluid stream. The adjunct loop comprises a heat collecting leg positionable within the combustion area of the furnace and a heat donating leg positionable adjacent a source of combustion air. Manipulation of the flow of process fluid through the heat donating leg provides control of the temperature of the combustion air and consequently control of the stack exhaust temperature. A valve system, which may be manually controlled or thermostatically controlled responds to a present, or desired, temperature of the stack exhaust.

12 Claims, 2 Drawing Sheets

FLUE GAS CONTROL

FIELD OF THE INVENTION

My invention relates to a heat exchange system which provides efficient means for supplying heat to a fluid process stream. More particularly, my invention relates to a heat exchange system in which a portion of a fluid stream recovers heat from combustion gases exiting a furnace and donates heat to combustion air entering the furnace to provide precise control of the temperature of the exhaust gases exiting the furnace and combustion air entering the furnace.

BACKGROUND OF THE INVENTION

The most basic concept of heat exchange may be described as a transfer of heat from a means for producing heat to a means for accepting that heat.

Most simply, a heat exchange system may comprise a tubular component through which heated fluid flows to transfer heat to fluid flowing through a separate tubular component.

For example, a heat exchange system may comprise a first device in which a fluid stream is heated so as to transfer heat from that fluid to a second device through which a fluid stream passes without any mixing of the two fluid streams. A simple form of such heat exchanger comprises an automobile radiator. In this heat exchanger the auto engine pumps heated water into the radiator in which the heated water is cooled by the action of air being driven through the radiator so that cooled water may flow back into the engine. The heated water and the cool air are independent.

In a typical chemical processing plant the application of heat may be necessary to initiate and maintain a chemical reaction. The heat required may, in some instances, be applied directly to reaction vessels from a heat generating apparatus, as a furnace, or, in some instances may be applied by heat presented through a heat exchange system.

One type of heat exchange system may comprise a fuel burner providing heat for a fluid within a tubular system which then disperses a chosen amount of the heat energy to a chemical process unit remote from the heat generating burner.

Heat generated by such a system may be transferred to a chemical process at a chosen temperature, or within a certain temperature range, by control of the rate of circulation of the heat exchange fluid, or control of the heat exchange application means, or control of the rate of flow of combustion air.

Previously, members of our company had designed and developed an efficient heat exchange system for a fluid process stream and combustion furnace which is designated as an adjunct loop system for efficient heating of combustion air.

The adjunct loop heat exchange system comprises the following steps and components:

1. A heat exchange component which includes a heat collecting coil and a heat donating coil associated with the combustion furnace.
2. A portion of a parent process fluid stream is directed through the heat collecting coil and heat donating coil at a controllable rate.
3. The portion of process fluid passes through the heat collecting coil in non-contact relation with flue gases for collection of heat from flue exiting the furnace and passes through the heat donating coil to transfer heat to combustion air entering the furnace.

I found the following patents during a search of the prior art in this field:

| | | |
|---|---|---|
| U.S. No. 3,861,334 | Stockman | Jan. 21, 1975 |
| U.S. No. 3,913,501 | Dahar | Oct. 21, 1975 |
| U.S. No. 4,101,265 | Broach et al | July 18, 1978 |
| U.S. No. 4,262,608 | Jackson | Apr. 21, 1981 |
| U.S. No. 4,449,569 | Lisi et al | May 22, 1984 |
| U.S. No. 4,485,746 | Erlandsson | Dec. 4, 1984 |
| U.S. No. 4,628,869 | Symsek et al | Dec. 16, 1986 |

U.S. Pat. No. 3,861,334 to Stockman describes an incinerator wherein hot exhaust gases are directed in heat exchange relation with heat exchange fluid in a boiler. Exhaust gas is diluted with cooled gas that exits the boiler. An afterburner placed in the exhaust stack provides means for maintaining a chosen temperature in the afterburner chamber.

U.S. Pat. No. 3,913,501 to Dahar describes an incinerator for waste material containing both organic and inorganic material. The system provides a combustion chamber having means at the bottom for collecting ash produced, and includes means for supplying combustion air to the interior of the combustion chamber including a plurality of vertically spaced apertured ducts within the lower portion of the combustion chamber.

U.S. Pat. No. 4,101,265 to Broach et al is the closest of these references. My present invention is found to be more energy efficient than this prior invention developed by members of our company. Broach et al describes a heat exchange system in which a portion of a process fluid stream performs as a heat exchange fluid. A loop member in communication with a process fluid stream comprises a first portion within a furnace for collecting heat from flue gases and a second portion within a combustion chamber for donating heat to combustion air. A pump in the loop member provides means for circulating the fluid into and through the loop at a controllable rate of circulation substantially independently of the fluid process stream. A valve in the loop may be closed to direct fluid flow through the loop. If the pump should become inoperative, the valve is opened, and in conjunction with a pressure differentiation induced by a restriction in the fluid stream, a portion of the process fluid stream is directed through the adjunct loop to prevent overheating of the loop component.

U.S. Pat. No. 4,262,608 to Jackson describes a combination flue products exhaust and combustion air supplied for and limited to vented gas burning devices. Exhaust products are given a positive exhaust while balanced pre-heated combustion air is driven into the combustion compartment. An air intake pipe delivers combustion air upon selective activation of the air intake fan. An exhaust pipe delivers the flue gases to the atmosphere upon selective activation of an exhaust fan. An air intake damper and a flue products exhaust damper operate automatically to close the flue products exhaust line when the fans are not running.

U.S. Pat. No. 4,449,569 to Lisi et al describes an air preheater for supplying heated air to a furnace through parallel-connected conduits with heat transfer performed by the movement through a second of such conduits. Rate of flow of air to be preheated is determined by temperature and/or pressure differentials at points of joinder of two sets of conduits.

U.S. Pat. No. 4,485,746 to Erlandsson describes an energy system for an incinerator connected to a stack, an auxiliary conduit forming a lower extension of the stack, an outlet conduit connected to the stack downstream of the auxiliary conduit, a boiler connected between the auxiliary conduit and the outlet conduit, a burner connected to the auxiliary conduit which becomes operable to supply heat to the boiler when the incinerator is not operating, a blower located in outlet conduit to assist outlet flow of flue gases, a damper in the outlet conduit between the boiler and blower, a temperature sensor in a conduit between incinerator and stack which determines mode of operation of incinerator and burner, a first flow sensing mechanism in outlet conduit upstream of the burner, a second flow sensing mechanism in stack downstream of connection of auxiliary conduit. Burner becomes operative when incinerator is not operating, and first flow sensing mechanism controls damper to direct heated gases from burner through boiler. When incinerator is operating, second flow sensing mechanism controls damper to direct heated gases through auxiliary conduit to boiler.

U.S. Pat. No. 4,638,869 to Symsek et al describes a system for recovering waste heat from a variable temperature process heater exhaust stack. Includes a heat exchanger collecting heat from the waste gas stack with heat delivered thereby to a heat reservoir. The heat transfer fluid passes independently to two heat exchangers, one for combustion air and one for fuel gas. The heated combustion air and fuel gas then return to the process heater. A source of pressurized inert gas passes through a line to the reservoir in sufficient pressure to maintain the heat transfer fluid in liquid condition throughout the circuit.

SUMMARY OF THE INVENTION

The primary object of my invention is to provide a heat exchange system which is efficient and easily controllable and simple in construction.

Another object of my invention is to provide a heat exchange system capable of maintaining easy control of heat transfer from remote heat collection and heat donating means.

Still another object of my invention is to include means for accurately determining and regulating temperature of a heat transfer fluid.

Still another object of my invention is to provide a heat exchange system in which temperature and degree of mixture of heated fluids may be controlled.

Still another object of my invention is to provide a heat exchange system in which a chosen operating temperature of flue gases may be closely and accurately related to a favorable operating temperature of combustion air.

Still another object of my invention is to provide means which is adaptable to maintain a substantial constant draft of combustion air to enhance smooth operation of a process furnace, coincidentally preventing burner malfunction from loss of draft.

My invention describes and explains the advantages of a further improved heat exchange system which enhances the efficiency in the transfer of energy from a heat collecting component of the system to a heat donating component of the system. For example, with a system operable by combustible fuel which therefore requires combustion air, a heat collecting component will transfer energy from flue gases emitted by the system to combustion air entering the system.

My system is designed to carefully regulate and coordinate the rate of transfer of energy between flue gases and combustion air by coordinating temperature of flue gases exiting the process unit with the portion of process stream flowing through the heat collecting component in a manner to permit a rise in flue gas temperature in coordination with a lower flow of portion of process fluid, and cause a decrease in flue gas temperature in coordination with a higher flow of a portion of fluid process stream through the heat exchange system.

Measurement of the temperature of the flue gases directs a signal to a temperature receiving member regulating the flow of the portion of the process fluid stream.

A temperature responsive device advantageously placed with respect to the flue gases sends a proper signal to the heat donating component indicating the flue gas temperature. Then, the heat donating component, which includes responsive valve means, properly adjusts the flow of the portion of process fluid stream, thus suitably tempering the temperature of the flue gases.

When the temperature of the flue gases is indicated to be higher than preferred, an increase in the flow of the portion of process stream is then made to reduce the temperature of the flue gases. When the temperature of the flue gases is indicated to be lower than preferred, a reduction in the flow of the portion of process stream through the heat donating component is then made, thus causing the temperature of the portion of process stream to increase and consequently raise the temperature of the flue gases.

I have found that the heat control system I am describing herein also provides means for maintaining a constant draft of combustion air for the system which assures a smooth operation of the furnace burners along with means for preventing slag deposition on the heat exchange coils, tubes, and furnace walls.

The heat exchange system described herein comprises a furnace for heating a process fluid stream, the furnace including a source of combustible fuel with means for supplying air to the fuel, means for transmitting process fluid through the heat exchange system including means for transmitting a portion of the process fluid controllably through an adjunct loop component by means of a flow-controlled component in communication with the adjunct loop for providing means for coordinating temperature of flue gases emitting from the system with a rate of flow of the portion of process fluid.

DESCRIPTION OF THE PREFERRED EMBODIMENTS

My present invention may be incorporated into heating systems which are operable by fuel requiring a source of air for combustion.

I have designed my heat exchange control system in a manner to conserve heat energy by recovering heat energy from flue gases and delivering a beneficial amount of heat energy to a portion of the fluid stream and combustion air entering the furnace component.

Figure 1:
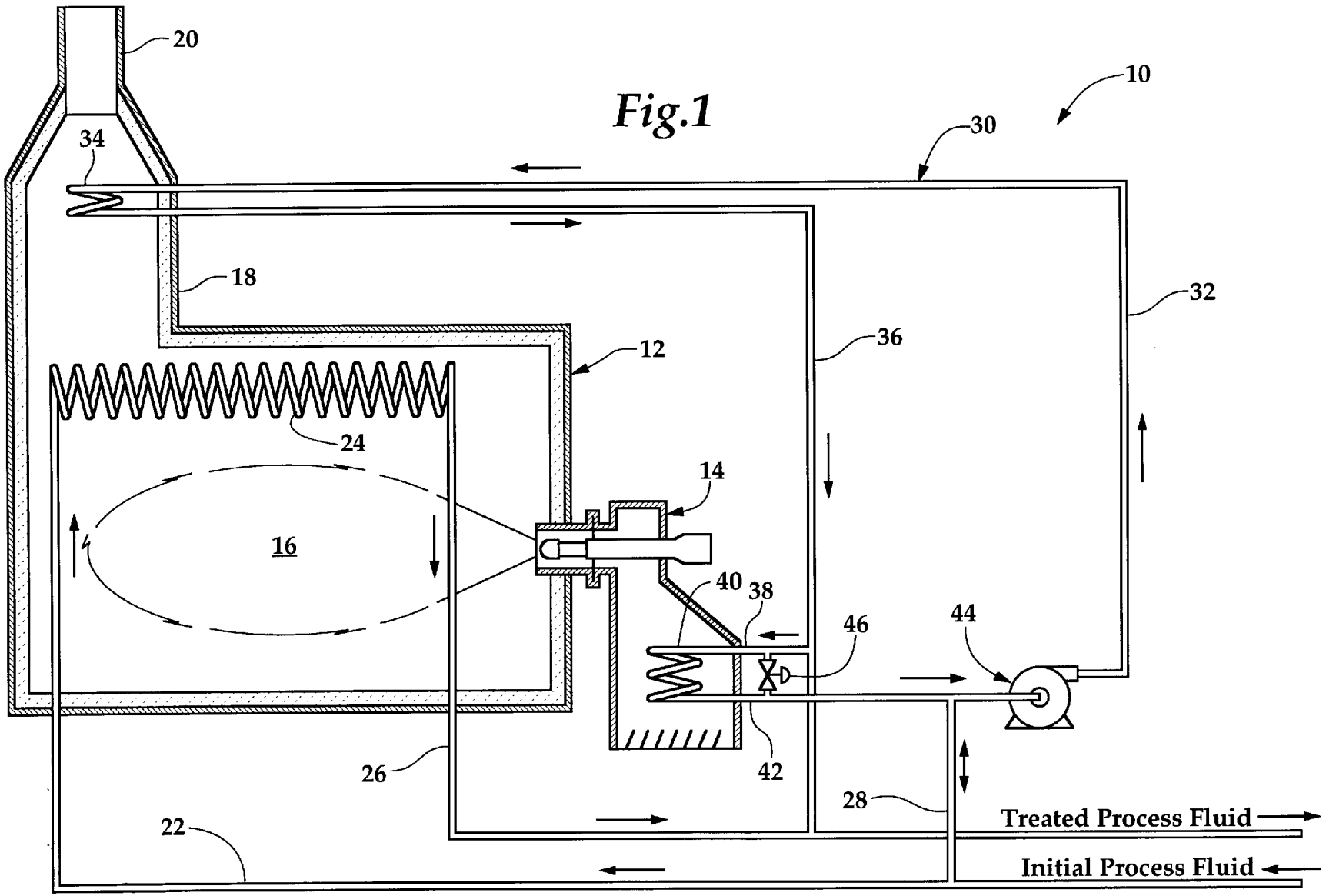
FIG. 1 is a sectional view of a flue gas control heat exchange system according to my invention indicating one means for coordinating temperature of flue gas with process fluid and combustion air.

FIG. 1 describes a heat exchange system 10, generally, comprising a furnace component 12, generally, having a burner 14, generally, a radiant section 16, a flue member 18, and a stack 20.

The furnace 12, generally, and related components I have described, identify a typical combustion unit of a heat exchange system for supplying heat to a fluid process stream.

I depict the fluid process stream being heated by this system as being supplied through an inlet process fluid line 22 which enters the radiant section 16 of the furnace 12 to form a process coil 24, and exits the furnace 12 through heated process fluid line 26.

The major component of the heat exchange system within which I have incorporated my improvement comprises an adjunct loop arrangement which I described above and which includes a first inlet line 28 to an adjunct loop 30, generally, which loop includes a first loop line 32, which enters flue 18 to form a heat collecting coil 34; and a second loop line 36, which provides an outlet line from heat collecting coil 34, and joins the treated process fluid line 26.

A first branch line 38 enters a side of burner 14 within which burner branch line 38 connects with a heat donating coil 40 which then connects with a second branch line 42 which then enters a pump component 44, generally.

I have provided a valve member 46 joining branch lines 38 and 42 as a means for providing efficient and accurate temperature control and heat transfer between the flue 18 and burner 14 for heat manipulation as I outlined above. Valve 46 may be a manual valve controllable as desired upon observation of the temperature differences between heat collecting coil 34 and heat donating coil 40, or may be some form of automatic control which could be automatically attuned to temperature differences between the flue 18 and burner 14.

Placing valve 46 in a closed condition directs the flow of all of the fluid from loop line 36 through first branch line 38, heat donating coil 40, second branch line 42, pump 44, first loop line 32, and ultimately through heat collecting coil 34.

The increase in flow of the portion of process fluid through heat collecting coil 34 and heat donating coil 40 causes a reduction in the temperature of the flue gases emitting from stack 20.

Placing valve 46 in an open condition will reduce the flow of process fluid through heat collecting coil 34 and heat donating coil 40, thus permitting a rise in the temperature of the flue gases.

For convenience, I have described fully open and fully closed conditions of the valve 46. It is understood, of course, that valve 46 is adjustable in response to the desired temperature conditions of the flue gases and may be accurately controlled according to those conditions.

Figure 2:
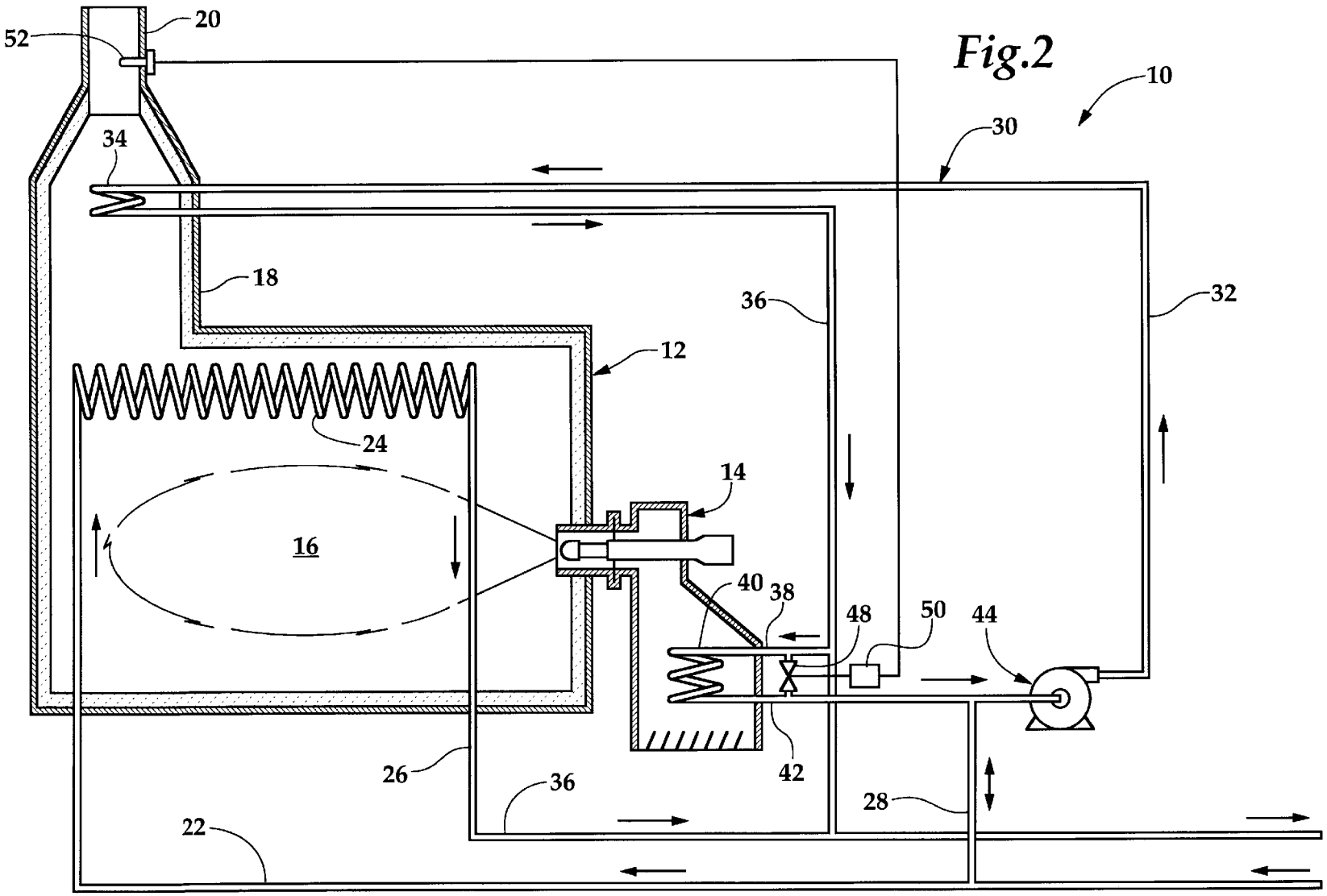
FIG. 2 is a sectional view of an alternate embodiment of a flue gas control heat exchange system according to my invention showing an automatic means for controlling flue gas temperature.

FIG. 2 describes essentially the system shown in FIG. 1, but incorporating an automatic valve providing measurement of flue gas temperature and coordination of the rate of flow of process fluid through the adjunct loop with a flue gas temperature.

An automatic valve member 48 responds to action from a control device 50 in further response to a thermocouple member 52 positioned within the stack 20. A measurement of excess heat by the thermocouple 52 directs valve control device 50 to cause valve 48 to close a desired amount to direct more process fluid to pass through the adjunct loop 30, thus collecting heat from the flue 18 and donating a controllable amount of heat to heat donating coil 40 in a manner to remove that heat from the stack and reduce the heat of the process system by increased flow of the process fluid stream.

Since many different embodiments of my invention may be made without departing from the spirit and scope thereof, it is to be understood that the specific embodiments described in detail herein are not to be taken in a limiting sense, since the scope of the invention is best defined by the appended claims.

I claim;:

1. A furnace for heating a process fluid stream, comprising:

a burner to fire fuel with combustion air to supply heat to said fluid stream with concomitant production of flue gases from said fuel, means for presenting the fluid stream to said furnace, an adjunct loop component for circulating a portion of the fluid stream thru the furnace, comprising:

means for collecting heat from flue gases being exited from the furnace, and means for donating heat to combustion air entering the furnace including a first branch line entering the burner to connect with a heat donating member and a second branch line which connects said heat donating member to a pump component, and a flow control component in communication with said means for collecting heat from said flue gases and in communication with said means for donating heat to said combustion air, said flow control component includes a valve member joining first branch line and second branch line to coordinate temperature of flue gases with rate of flow of said portion of fluid stream and control of temperature of combustion air.

2. A furnace for heating a process fluid stream as described in claim 1, wherein:

said means for presenting the fluid stream to said furnace comprises a first fluid stream line entering the furnace, a second fluid stream line exiting the furnace, and a pump member downstream of said means for donating heat to combustion air.

3. A furnace for heating a process fluid stream as described in claim 2, wherein:

said flow control component includes a temperature controller responsive to flue gas temperature, and said temperature controller includes means for delivering a signal to a valve in said adjunct loop in a manner to regulate flow of said portion of fluid stream through said adjunct loop.

4. A furnace for heating a process fluid stream as described in claim 3, wherein:

said means for collecting heat from the flue gases comprises a heat collecting member, said means for donating heat to the combustion air comprises a heat donating member, and said flow control component is in communication with said heat collecting member and said heat donating member.

5. A furnace for heating a process fluid stream as described in claim 4, wherein:

said heat collecting member is positionable within a stack which provides exit for the flue gases, and said heat donating member is positionable adjacent a combustion air inlet.

6. A furnace for heating a process fluid stream as described in claim 5, wherein:

said flow control component is positionable exteriorly adjacent the burner.

7. A furnace for heating a process fluid stream as described in claim 6, wherein:

said flow control component includes means for variably controlling the rate of flow of the fluid stream thru the adjunct loop.

8. A furnace for heating a process fluid stream as described in claim 7, wherein:

said heat collecting member comprises a coil portion of the adjunct loop, and said heat donating member comprises a coil portion of the adjunct loop.

9. A furnace for heating a process fluid stream as described in claim 8, wherein:

said flow control component comprises a manually operable valve member.

10. A furnace for heating a process fluid stream as described in claim 8, wherein:

said flow control component comprises an automatically operable valve system.

11. A furnace for heating a process fluid stream as described in claim 10, wherein:

said automatically operable valve system is actuable in response to a temperature responsive component adaptable to respond to a temperature of the flue gases.

12. A furnace for heating a process fluid stream as described in claim 11, wherein:

said automatically operable valve system comprises:

a thermocouple component in said stack, and means responsive to the thermocouple for operating a valve member.

* * * * *